US008258949B1

(12) United States Patent
Jaynes

(10) Patent No.: US 8,258,949 B1
(45) Date of Patent: Sep. 4, 2012

(54) INTRUDER DETECTION ALARM AND DETERRENT DEVICE

(76) Inventor: Ronald Jaynes, St. Charles, IL (US)

( * ) Notice: Subject to any disclaimer, the term of this patent is extended or adjusted under 35 U.S.C. 154(b) by 327 days.

(21) Appl. No.: 12/789,003

(22) Filed: May 27, 2010

Related U.S. Application Data

(60) Provisional application No. 61/217,103, filed on May 27, 2009.

(51) Int. Cl.
*G08B 13/00* (2006.01)

(52) U.S. Cl. ..... 340/541; 340/332; 340/506; 340/511; 340/522; 340/565; 340/567; 340/568.1; 340/545.3

(58) Field of Classification Search ..... 340/541, 340/545.1, 565, 522, 555, 567, 506, 511, 340/568.1, 332
See application file for complete search history.

(56) References Cited

U.S. PATENT DOCUMENTS

| | | | | |
|---|---|---|---|---|
| 5,015,994 | A * | 5/1991 | Hoberman et al. | 340/567 |
| 5,457,442 | A | 10/1995 | Lucero | |
| 5,489,891 | A * | 2/1996 | Diong et al. | 340/567 |
| 5,673,022 | A * | 9/1997 | Patel | 340/565 |
| 7,075,430 | B2 * | 7/2006 | Rolf et al. | 340/545.3 |
| 7,122,976 | B1 | 10/2006 | Null | |
| 7,165,864 | B2 | 1/2007 | Miller | |
| 2007/0030148 | A1 * | 2/2007 | Gabriel et al. | 340/540 |

* cited by examiner

*Primary Examiner* — Tai T Nguyen

(57) ABSTRACT

A combined night light and alarm device preferably includes a portable housing, a light emitting section located inside the housing, an alarm section located inside the housing, and a plug attached to the housing and adapted to be removably connected to an existing electrical outlet. An audible alarm is included for notifying residents/occupants when the device senses motion of unauthorized persons. Such a plug may be electrically coupled to the light emitting section and the alarm section respectively. A logic gate may be located inside the housing. Such a logic gate may be electrically coupled to the light emitting section and the alarm section respectively. In this manner, the logic gate cooperates with the light emitting section and the alarm section in such a manner that light and sound are automatically emitted upon simultaneously detecting first and second triggering events around the housing.

14 Claims, 6 Drawing Sheets

INTRUDER DETECTION ALARM AND DETERRENT DEVICE

CROSS REFERENCE TO RELATED APPLICATIONS

This application claims the benefit of U.S. Provisional Application No. 61/217,103, filed May 27, 2009, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to detection devices and, more particularly, to an intruder detection, alarm and deterrent device for providing homeowners and the like with a convenient means of increasing the safety of their home from unwarranted entry by unauthorized persons.

2. Prior Art

Intrusion detection systems for detecting and signaling an alarm when activated by an intruder are well known. The use of transmitters for providing wireless communication between elements of such systems is also known in the art. A review of the known prior art examples highlights the fact that existing security systems which are capable of remote operation of an alarm, are quite bulky, are very complex, and accordingly very expensive. In addition to the high initial expense, installing and maintaining such complex systems are also costly. Typically, both installation and maintenance of such systems must be done by highly trained technicians. Further, it is axiomatic that the dependability of any system decreases as its complexity increase.

Accordingly, a need remains for an intruder detection, alarm and deterrent device in order to overcome the above-noted shortcomings. The present invention satisfies such a need by providing a device that is convenient and easy to use, is durable yet lightweight in design, is versatile in its applications, and provides businesses and households a convenient means of preventing entry from unauthorized persons.

BRIEF SUMMARY OF THE INVENTION

In view of the foregoing background, it is therefore an object of the present invention to provide a combined night light and alarm device for detecting and deterring an intruder from a dwelling. These and other objects, features, and advantages of the invention are provided by a combined night light and alarm device preferably including a portable housing, a light emitting section located inside the housing, an alarm section located inside the housing, and a plug attached to the housing and adapted to be removably connected to an existing electrical outlet. Such a plug may be electrically coupled to the light emitting section and the alarm section respectively.

The combined night light and alarm device may further include a logic gate located inside the housing. Such a logic gate may be electrically coupled to the light emitting section and the alarm section respectively. In this manner, the logic gate cooperates with the light emitting section and the alarm section in such a manner that light and sound are automatically emitted upon simultaneously detecting first and second triggering events around the housing. The combination of such a structural configuration provides an unpredictable and unexpected benefit of discretely identifying and deterring an intruder while simultaneously illuminating a pathway adjacent to the housing.

In one embodiment, the light emitting section preferably includes a light emitting source positioned within the housing, a light switch in electrical communication with the light emitting source and the plug, and a photo sensor in electrical communication with the plug and the logic gate.

In one embodiment, the light switch is capable of being manually toggled between open and closed positions and thereby manually causes the light emitting source to emit a first output signal independently of the detection of the first triggering event.

In one embodiment, upon detecting the first triggering event, the photo sensor may generate and transmit a true first detection signal to the logic gate. Alternately, the photo sensor may generate and transmit a false first detection signal to the logic gate when the first triggering event is not detected.

In one embodiment, the alarm section preferably includes an audible alarm positioned within the housing, an alarm switch in electrical communication with the audible alarm and the plug, and a motion sensor in electrical communication with the plug and the logic gate.

In one embodiment, the alarm switch is capable of being manually toggled between open and closed positions and thereby manually causes the audible alarm to emit a second output signal independently of the detection of the second triggering event.

In one embodiment, upon detecting the second triggering event, the motion sensor may generate and transmit a true second detection signal to the logic gate. Alternately, the motion sensor may generate and transmit a false second detection signal to the logic gate when the second triggering event is not detected.

Notably, the logic gate preferably generates and transmits a true output signal to each of the light emitting sources and the audible alarm upon receiving the true first and second detection signals. Alternately, the logic gate may generate and transmit a false output signal to each of the light emitting sources and the audible alarm upon receiving at least one of the false first and second detection signals.

In this manner, the light emitting source and the audible alarm may be simultaneously activated and thereby simultaneously emit the first and second output signals upon receiving the true output signal from the logic gate. Likewise, the light emitting source and the audible alarm may be simultaneously deactivated upon receiving the false output signal from the logic gate.

The present invention may further include a method of utilizing a combined night light and alarm device for detecting and deterring an intruder from a dwelling. Such a method preferably includes the chronological steps of: providing a portable housing; providing and locating a light emitting section inside the housing; providing and locating an alarm section inside the housing; providing and attaching a plug to the housing; electrically coupling the plug to the light emitting section and the alarm section respectively; providing and locating a logic gate inside the housing; electrically coupling the logic gate to the light emitting section and the alarm section respectively; and removably connecting the plug to an existing electrical outlet.

The method may further include the step of: the logic gate cooperating with the light emitting section and the alarm section in such a manner that light and sound are automatically emitted upon simultaneously detecting first and second triggering events around the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
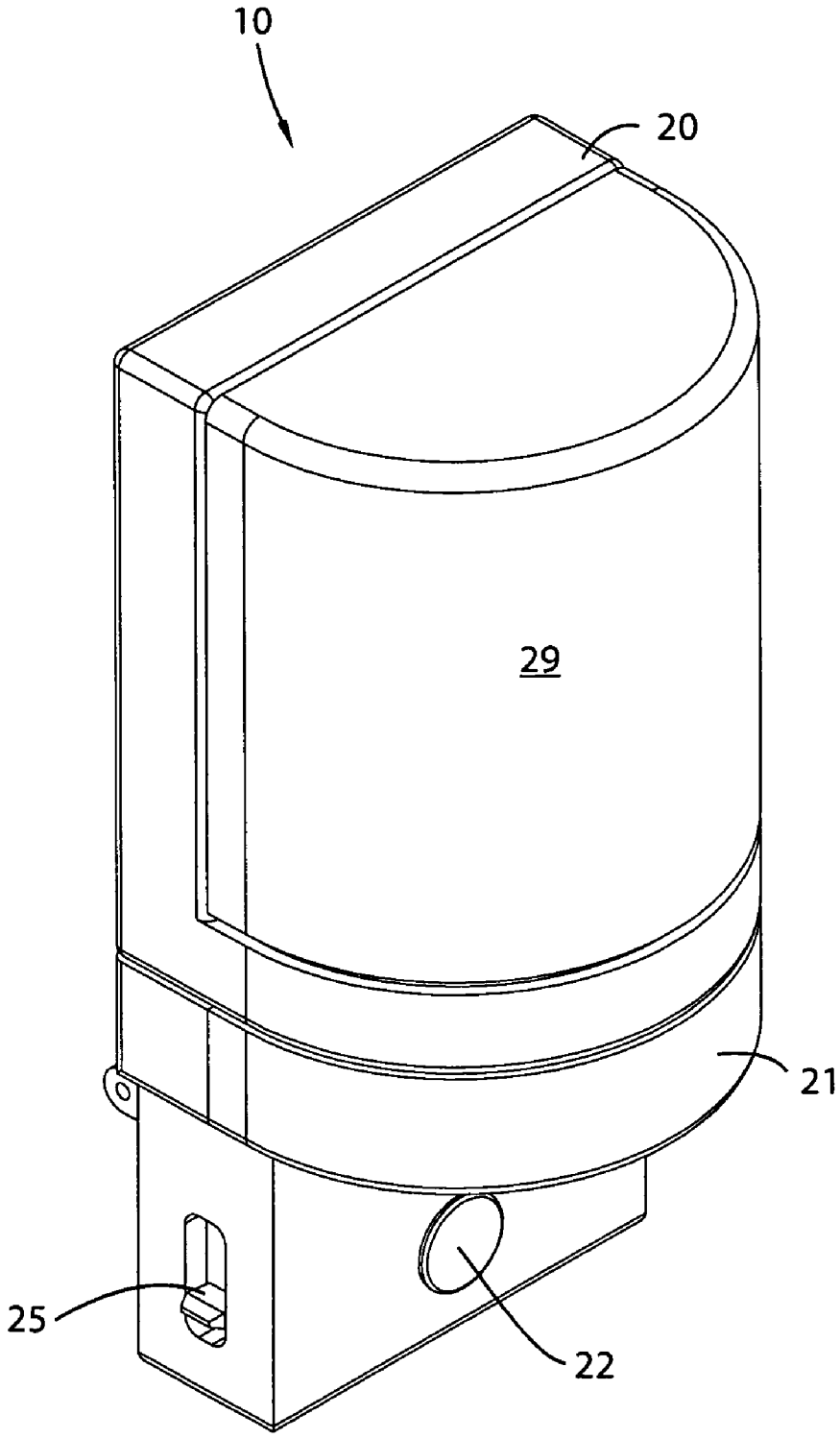
FIG. 1 is a front perspective view showing a combined night light and alarm device, in accordance with the present invention.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "present invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The below disclosed subject matter is to be considered illustrative, and not restrictive, and the appended claims are intended to cover all such modifications, enhancements, and other embodiments which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

Figure 2:
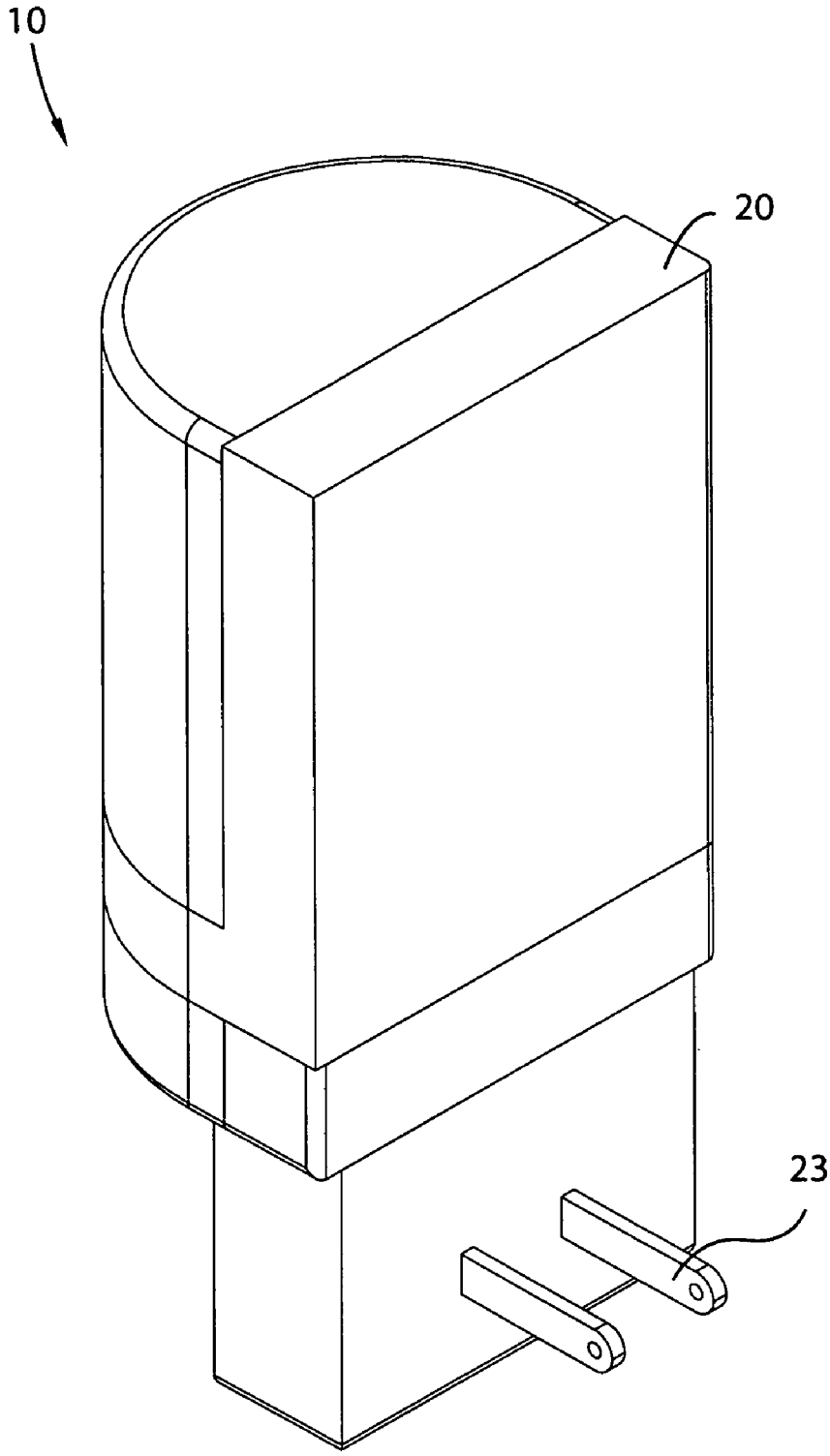
FIG. 2 is a rear perspective view showing a combined night light and alarm device.
Figure 3:
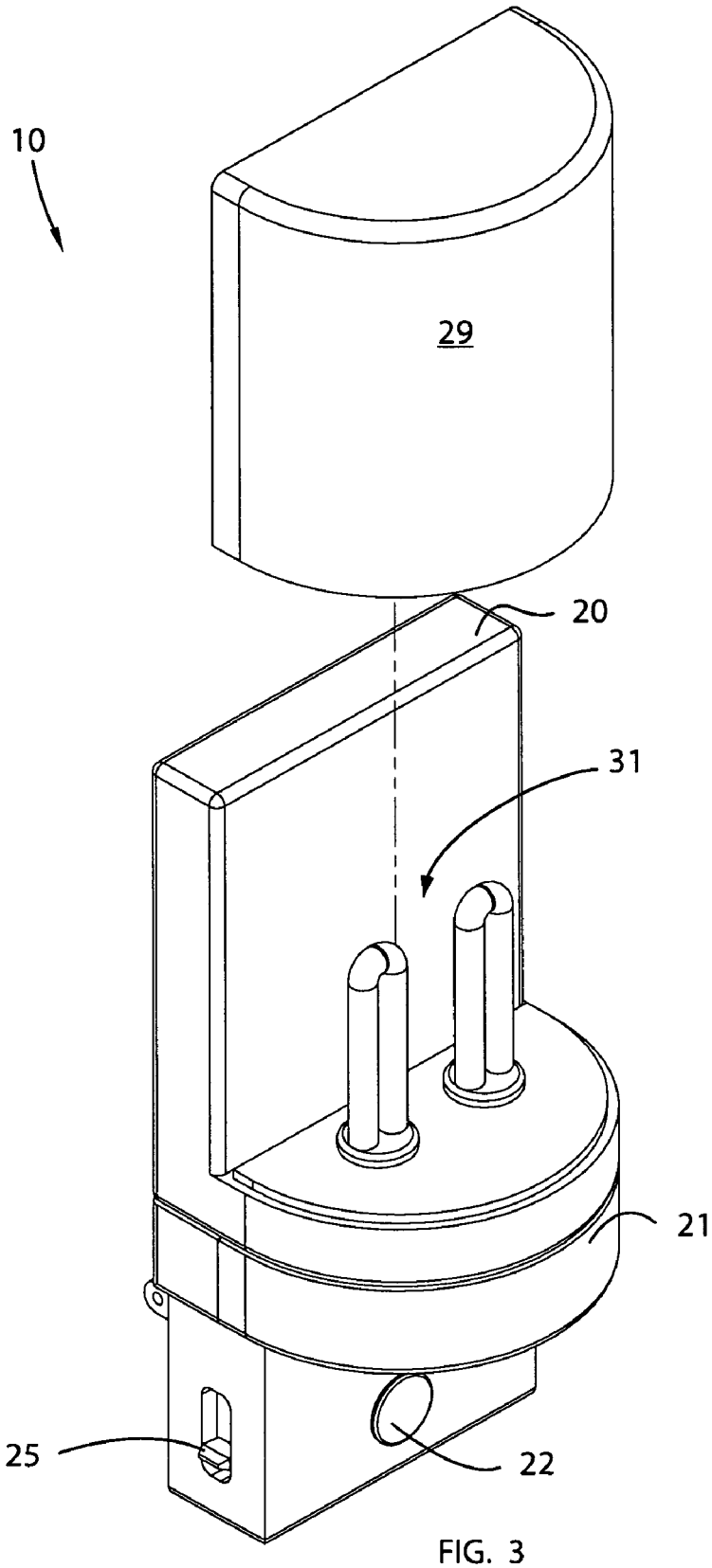
FIG. 3 is an exploded view showing the lens removable attached to housing.
Figure 4:
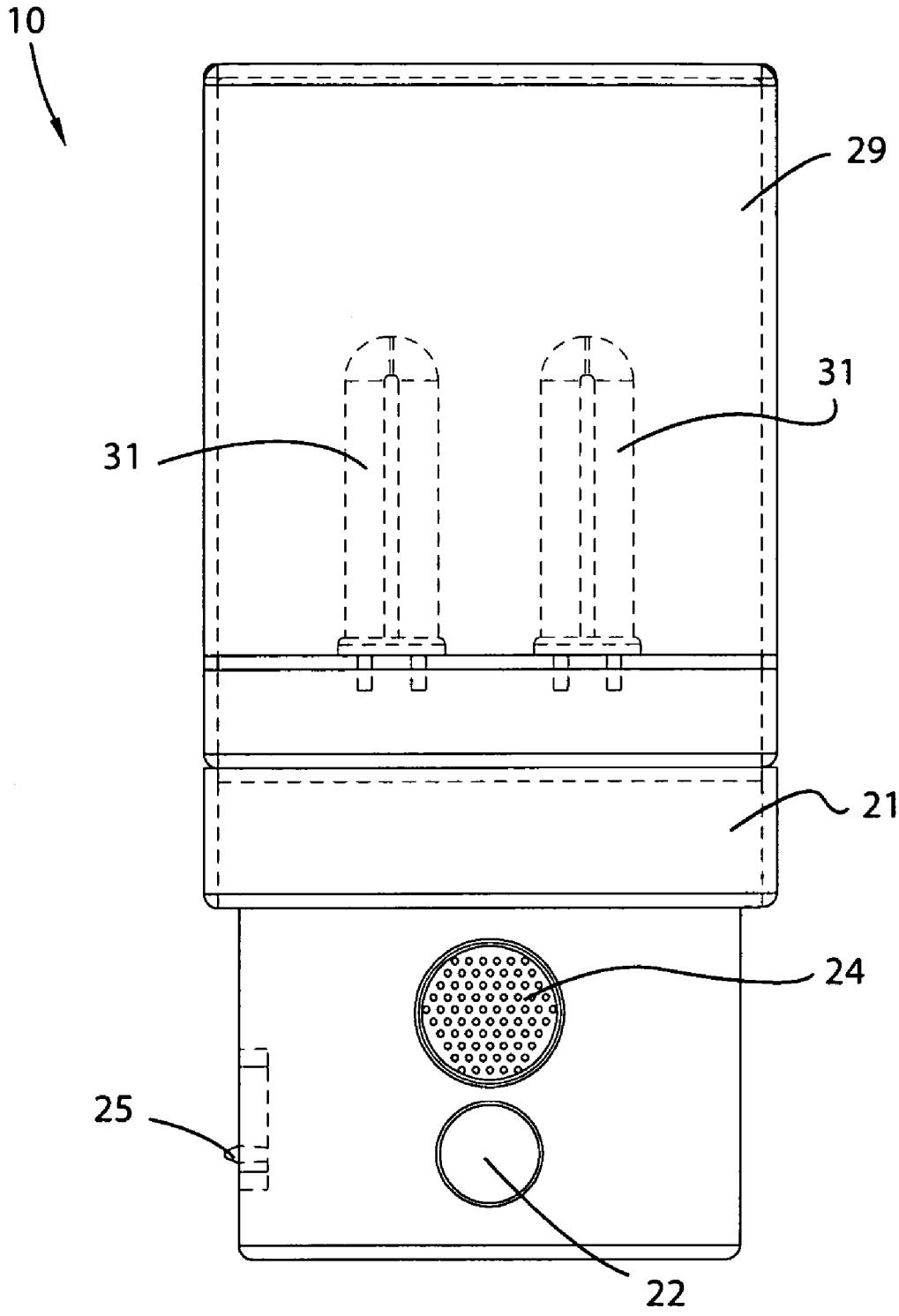
FIG. 4 is a front elevational view showing the light emitting sources situated inside the housing.
Figure 5:
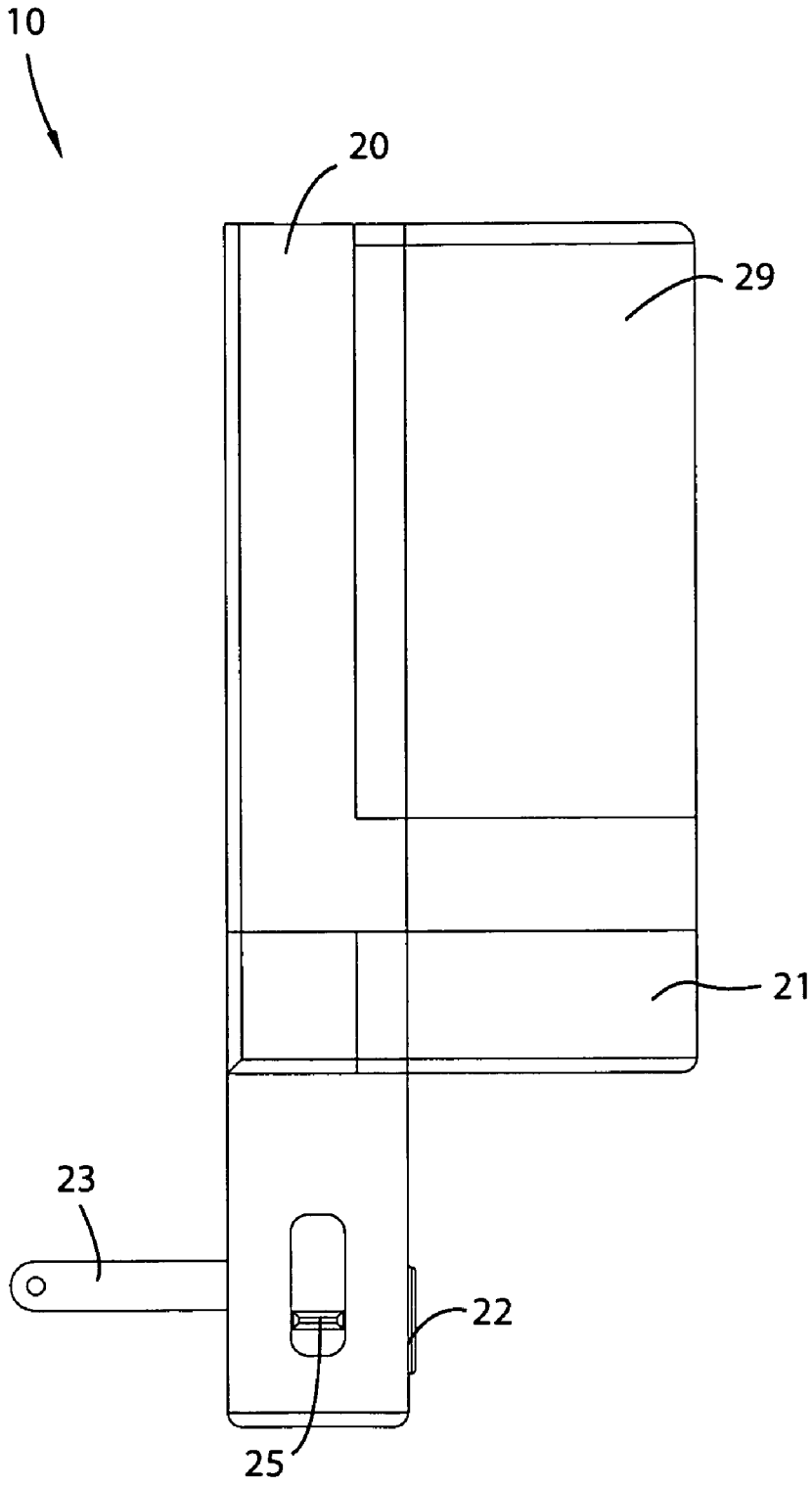
FIG. 5 is a side elevational view of the combined night light and alarm device of FIG. 1.
Figure 6:
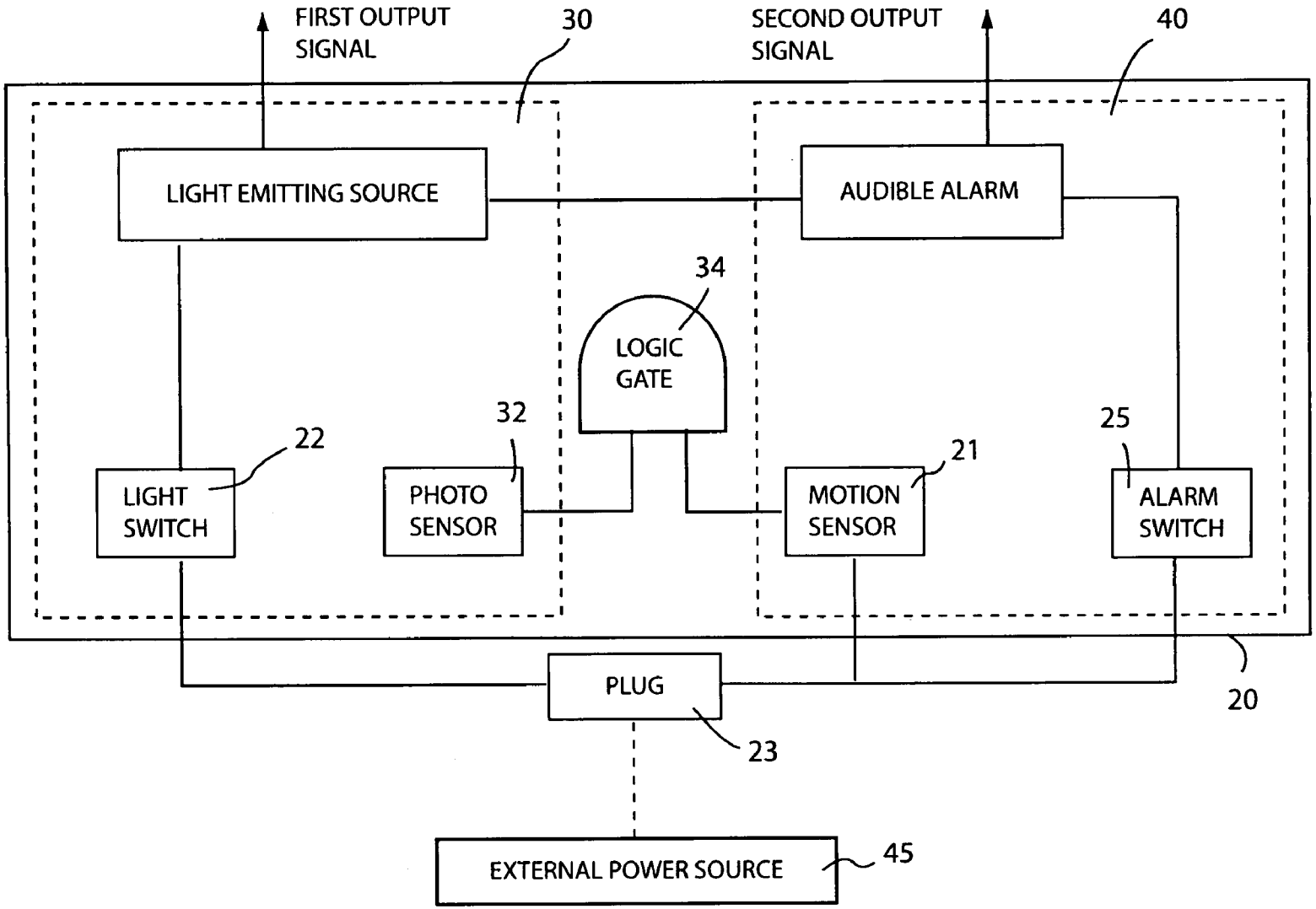
FIG. 6 is a high-level schematic block diagram illustrating the electrical communication between the major electronic components of the present invention.

The device 10 of this invention is referred to generally in the FIGS. 1-6 and is intended to provide an intruder detection, alarm and deterrent device 10. It should be understood that the device 10 may be used to detect unauthorized persons in a variety of applications and should not be limited to only being used in homes and business establishments.

Referring to FIG. 16 in general, the combined night light and alarm device 10 preferably includes a portable housing 20 that may be provided with a detachable lens 29. A light emitting section 30 may be located inside the housing 20, an alarm section 40 may be located inside the housing 20, and a plug 23 may be attached to the housing 20 and adapted to be removably connected to an existing electrical outlet 45 such as a conventional 110 volt, 60 hertz outlet, for example. Such a plug 23 may be electrically coupled to the light emitting section 30 and the alarm section respectively. An audible alarm 24 is preferably included for notifying residents/occupants when the device 10 senses motion of unauthorized persons surrounding housing 20.

The combined night light and alarm device 10 may further include a logic gate 34 located inside the housing 20. Such a logic gate 34 may be electrically coupled to the light emitting section 30 and the alarm section 40 respectively. Notably, the logic gate 34 cooperates with the light emitting section 30 and the alarm section 40 in such a manner that light and sound are automatically emitted from housing 20 upon simultaneously detecting first and second triggering events around the housing 20. Such first and second triggering events may be low ambient lighting adjacent to housing 20 and movement surrounding the housing 20, for example. The combination of such a structural configuration provides an unpredictable and unexpected benefit of discretely identifying and deterring an intruder while simultaneously illuminating a pathway adjacent to the housing 20.

In one embodiment, the light emitting section 30 may include a light emitting source 31, such as a pair of photo cells, positioned within the housing 20. A light switch 22 may be in electrical communication with the light emitting source 31 and the plug 23. Such a light switch 22 preferably extends outwardly from a front face of housing 20. Light switch 22 is included for toggling the device 10 between various operating modes, such as turning device 10 "OFF" or selecting a "NIGHT ONLY" mode, for example.

In one embodiment, the light switch 22 is capable of being manually toggled between open and closed positions and thereby manually causes the light emitting source 31 to emit a first output signal (light rays from the photo cells 31) independently of the detection of the first triggering event.

In one embodiment, a photo sensor 32 may be in electrical communication with plug 23 and the logic gate 34, for detecting the first triggering event (low ambient lighting). Upon detecting the first triggering event, the photo sensor 32 may generate and transmit a true first detection signal to the logic gate 34. Alternately, the photo sensor 32 may generate and transmit a false first detection signal to the logic gate 34 when the first triggering event is not detected (adequate ambient lighting). Such a photo sensor 32 preferably has a 180° field of vision, which is important for detecting ambient light in planes perpendicular, oblique, as well as parallel to housing 20.

In one embodiment, the alarm section 40 preferably includes an audible alarm 24 positioned within housing 20, an alarm switch 25 in electrical communication with the audible alarm 24 and the plug 23, and a motion sensor 21 in electrical communication with the plug 23 and the logic gate 34. Such a motion sensor 21 preferably has a 180° field of vision, which is important for detecting motion occurring in planes perpendicular, oblique, as well as parallel to housing 20. For example, the audible alarm 24 may include an audio speaker, and/or a mechanical/electromechanical device 10 that is capable of generating vibrations and sounds.

As noted hereinabove, one or more sensor(s), such as motion sensor 21 and photo sensor 32 may be provided to detect different triggering events, for example. Active and/or passive sensors may be used to react to detectable subject matter such as light, noise, radiation (e.g., heat), or changes in emitted energy, fields or beams. However, the invention is not limited to a particular type of sensor. Those skilled in the art will appreciate that other sensors may be used without departing from the scope of the invention. Examples of such other sensors may include optical sensors configured to sense light; microwave sensors that use a Gunn diode operating within pre-set limits to transmit/flood a designated area/zone with an electronic field whereby movement in the zone disturbs the field and sets off an alarm; an ultrasonic sensor configured to react to a determined range of ultrasonic sound energy in a protected area; or any other sensor capable of providing light and/or motion detection capability in accordance with principles of the invention.

In one embodiment, the alarm switch 25 is capable of being manually toggled between open and closed positions and thereby manually causes the audible alarm 24 to emit a second output signal (audible noise) independently of the detection of the second triggering event. Such an alarm switch 25 is included for toggling the device 10 between various operating modes, like turning the audible alarm "OFF" or selecting a "NIGHT ONLY" mode.

In one embodiment, upon detecting the second triggering event (movement surrounding housing 20), the motion sensor 21 may generate and transmit a true second detection signal to the logic gate 34. Alternately, the motion sensor 21 may generate and transmit a false second detection signal to the logic gate 34 when the second triggering event is not detected (no movement).

Notably, the logic gate 34 preferably generates and transmits a true output signal to each of the light emitting source 31 and the audible alarm 24 upon receiving the true first and second detection signals. Alternately, the logic gate 34 may generate and transmit a false output signal to each of the light emitting source 31 and the audible alarm 24 upon receiving at least one of the false first and second detection signals. The combination of such structural/functional elements provides an unpredictable and unexpected benefit of providing an alarm device that is discretely camouflaged in a night light while maintaining the functionality of the night light, which solves the problem of having to utilize a separate alarm controller with sensors that are readily identifiable and avoidable by an intruder.

In this manner, the light emitting source 31 and the audible alarm 24 may be simultaneously activated and thereby simultaneously emit the first and second output signals (light and audible noise) upon receiving the true output signal from the logic gate 34. Likewise, the light emitting source 31 and the audible alarm 24 may be simultaneously deactivated upon receiving the false output signal from the logic gate 34. Such first and second output signals may be optical and acoustic signals, for example. The combination of such structural/functional elements provides an unpredictable and unexpected benefit of simultaneously illuminating a target area while notifying a home owner whether an intruder has been detected without requiring separate and indiscrete illumination and alarm devices.

For example, the logic gate 34 receives a detection signal from photo sensor 32 and motion sensor 21, respectively. Such detection signals indicate whether the first and second triggering events are detected or not detected, for example. The logic gate 34 generates an output signal based upon a Boolean logic such as "on" and "off" or "true" and "false", which have high and low voltage levels respectively. The input (detection) signals of the logic gate 34 may be driven by voltages having two nominal values, e.g. 0V and 5V representing logic 0 and logic 1, respectively. The combination of the first and second detection signals determines whether the corresponding output signal from the logic gate 34 is "true" or "false." Such an output signal drives the simultaneous activation and deactivation of the light emitting source 31 and audible alarm 24. In one example, the logic gate 34 may be combined to form a digital circuit made from various electronic components such as transistors, impedances, capacitances, and other such devices 10.

The present invention may further include a method of utilizing a combined night light and alarm device 10 for detecting and deterring an intruder from a dwelling. Such a method preferably includes the chronological steps of: providing a portable housing 20; providing and locating a light emitting section 30 inside the housing 20; providing and locating an alarm section 40 inside the housing 20; providing and attaching a plug 23 to housing 20; electrically coupling the plug 23 to the light emitting section 30 and the alarm section 40 respectively; providing and locating a logic gate 34 inside the housing 20; electrically coupling the logic gate 34 to the light emitting section 30 and the alarm section 40 respectively; and removably connecting the plug 23 to an existing electrical outlet 45.

The method may further include the step of: the logic gate 34 cooperating with the light emitting section 30 and the alarm section 40 in such a manner that light and sound signals are automatically emitted upon simultaneously detecting first and second triggering events around the housing 20.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation.

What is claimed as new and what is desired to secure by Letters Patent of the United States is:

1. A combined night light and alarm device for detecting and deterring an intruder from a dwelling, said combined night light and alarm device comprising:

a housing;

a light emitting section located inside said housing;

an alarm section located inside said housing;

a plug attached to said housing and adapted to be removably connected to an existing electrical outlet, said plug being electrically coupled to said light emitting section and said alarm section respectively; and a logic gate located inside said housing, said logic gate being electrically coupled to said light emitting section and said alarm section respectively;

wherein said logic gate cooperates with said light emitting section and said alarm section in such a manner that light and sound are automatically emitted upon simultaneously detecting first and second triggering events around said housing wherein said light emitting section comprises:

a light emitting source positioned within said housing;

a light switch in electrical communication with said light emitting source and said plug; and a photo sensor in electrical communication with said plug and said logic gate;

wherein said alarm section comprises:

an audible alarm positioned within said housing;

an alarm switch in electrical communication with said audible alarm and said plug; and a motion sensor in electrical communication with said plug and said logic gate.

2. The combined night light and alarm device of claim 1, wherein said light switch is capable of being manually toggled between open and closed positions and thereby manually causes said light emitting source to emit a first output signal independently of said detection of said first triggering event.

3. The combined night light and alarm device of claim 1, wherein upon detecting said first triggering event said photo sensor generates and transmits a true first detection signal to said logic gate, wherein said photo sensor generates and transmits a false first detection signal to said logic gate when the first triggering event is not detected.

4. The combined night light and alarm device of claim 1, wherein said alarm switch is capable of being manually toggled between open and closed positions and thereby manually causes said audible alarm to emit a second output signal independently of said detection of said second triggering event.

5. The combined night light and alarm device of claim 1, wherein upon detecting said second triggering event said motion sensor generates and transmits a true second detection signal to said logic gate, wherein said motion sensor generates and transmits a false second detection signal to said logic gate when the second triggering event is not detected.

6. The combined night light and alarm device of claim 1, wherein said logic gate generates and transmits a true output signal to each of said light emitting sources and said audible alarm upon receiving said true first and second detection signals, said logic gate generating and transmitting a false output signal to each of said light emitting sources and said audible alarm upon receiving at least one of said false first and second detection signals.

7. The combined night light and alarm device of claim 6, wherein said light emitting source and said audible alarm are simultaneously activated and thereby simultaneously emit said first and second output signals upon receiving said true output signal from said logic gate, wherein said light emitting source and said audible alarm are simultaneously deactivated upon receiving said false output signal from said logic gate.

8. A combined night light and alarm device for detecting and deterring an intruder from a dwelling, said combined night light and alarm device comprising:

a portable housing;

a light emitting section located inside said housing;

an alarm section located inside said housing;

a plug attached to said housing and adapted to be removably connected to an existing electrical outlet, said plug being electrically coupled to said light emitting section and said alarm section respectively; and a logic gate located inside said housing, said logic gate being electrically coupled to said light emitting section and said alarm section respectively;

wherein said logic gate cooperates with said light emitting section and said alarm section in such a manner that light and sound are automatically emitted upon simultaneously detecting first and second triggering events around said housing wherein said light emitting section comprises:

a light emitting source positioned within said housing;

a light switch in electrical communication with said light emitting source and said plug; and a photo sensor in electrical communication with said plug and said logic gate;

wherein said alarm section comprises:

an audible alarm positioned within said housing;

an alarm switch in electrical communication with said audible alarm and said plug; and a motion sensor in electrical communication with said plug and said logic gate.

9. The combined night light and alarm device of claim 8, wherein said light switch is capable of being manually toggled between open and closed positions and thereby manually causes said light emitting source to emit a first output signal independently of said detection of said first triggering event.

10. The combined night light and alarm device of claim 8, wherein upon detecting said first triggering event said photo sensor generates and transmits a true first detection signal to said logic gate, wherein said photo sensor generates and transmits a false first detection signal to said logic gate when the first triggering event is not detected.

11. The combined night light and alarm device of claim 8, wherein said alarm switch is capable of being manually toggled between open and closed positions and thereby manually causes said audible alarm to emit a second output signal independently of said detection of said second triggering event.

12. The combined night light and alarm device of claim 8, wherein upon detecting said second triggering event said motion sensor generates and transmits a true second detection signal to said logic gate, wherein said motion sensor generates and transmits a false second detection signal to said logic gate when the second triggering event is not detected.

13. The combined night light and alarm device of claim 8, wherein said logic gate generates and transmits a true output signal to each of said light emitting sources and said audible alarm upon receiving said true first and second detection signals, said logic gate generating and transmitting a false output signal to each of said light emitting sources and said audible alarm upon receiving at least one of said false first and second detection signals.

14. The combined night light and alarm device of claim 13, wherein said light emitting source and said audible alarm are simultaneously activated and thereby simultaneously emit said first and second output signals upon receiving said true output signal from said logic gate, wherein said light emitting source and said audible alarm are simultaneously deactivated upon receiving said false output signal from said logic gate.

* * * * *